US005357066A

United States Patent [19]

Morel et al.

[11] Patent Number: 5,357,066

[45] Date of Patent: Oct. 18, 1994

[54] OPERATING MECHANISM FOR A FOUR-POLE CIRCUIT BREAKER

[75] Inventors: Robert Morel, Herbeys; Xavier Thomassin, Meylan, both of France

[73] Assignee: Merlin Gerin, France

[21] Appl. No.: 963,755

[22] Filed: Oct. 20, 1992

[30] Foreign Application Priority Data

Oct. 29, 1991 [FR] France ..... 91 13457

[51] Int. Cl.[5] ..... H01H 3/00; H01H 9/20

[52] U.S. Cl. ..... 200/17 R; 200/144 R

[58] Field of Search ..... 200/17 R, 18, 50 R, 200/50 C, 144 R, 148 F, 150 L

[56] References Cited

U.S. PATENT DOCUMENTS 4,376,270 3/1983 Staffen ..... 335/21
4,383,146 5/1983 Bur ..... 200/17 R
5,029,301 7/1991 Nebon et al. ..... 335/16

FOREIGN PATENT DOCUMENTS 0108022 5/1984 European Pat. Off. ..... H01H 71/00
2478368 9/1981 France ..... H01H 71/12
2124032 2/1984 United Kingdom ..... H01H 1/56

*Primary Examiner*—A. D. Pellinen
*Assistant Examiner*—Michael A. Friedhofer
*Attorney, Agent, or Firm*—Parkhurst, Wendel & Rossi

[57] ABSTRACT

The operating mechanism of the four-pole circuit breaker comprises an auxiliary mechanism coupled to the main mechanism. The spring of the auxiliary mechanism exerts a torque on the bar, opposing the force of the contact springs when the circuit breaker completes its closing travel and when it is closed; the spring ceases to act on the bar when the circuit breaker has begun its opening travel and when it is open.

12 Claims, 5 Drawing Sheets

OPERATING MECHANISM FOR A FOUR-POLE CIRCUIT BREAKER

BACKGROUND OF THE INVENTION

The invention relates to an operating mechanism for a four-pole electrical breaking apparatus, notably a circuit breaker comprising three poles respectively associated with the three phases and one pole associated with the neutral.

Generally speaking, the mechanism controlling opening and closing of a circuit breaker is associated with one of the poles. For three-pole circuit breakers, this mechanism being associated with the center pole, the lateral forces are distributed symmetrically on each side of the mechanism. For four-pole circuit breakers, the asymmetry introduced by the position of the mechanism gives rise to problems of flexion and/or torsion on the coupling means connecting the poles to one another. The document U.S. Pat. No. 4,383,146 proposes a solution to the above-mentioned drawbacks, which consists of adding an auxiliary mechanism to the pole associated with the neutral. This auxiliary mechanism modulates the resistive torque in the course of the operation due to an angular offset between the three poles associated with the phases and the pole associated with the neutral which defers actuation of the neutral pole; this mechanism notably comprises a compression spring to compensate the friction forces and favor passage of the dead point.

On account of its design, the above-mentioned solution does not enable the opening and closing operations of the four poles to be performed perfectly simultaneously. Moreover, it does not enable manufacture of the poles to be rationalized due to the differences existing between the poles associated with the phases and the pole associated with the neutral. Finally, the mechanism is subjected to large fatigue phenomena.

The object of the invention is to overcome the above-mentioned drawbacks and to enable a simple, economical, rugged and reliable four-pole circuit breaker to be manufactured.

SUMMARY OF THE INVENTION

The operating mechanism according to the invention is designed to operate simultaneously the four poles located-side by side according to a transverse direction. One of the two poles adjacent to the symmetry plane of the circuit breaker is designated as the main pole. The pole furthest away from the main pole is designated as the auxiliary pole, and comprises:

- a rotary elementary switching bar guided in rotation around a first transverse axis;
- at least one stationary contact; and
- a single or double-break rotary contact, coupled in rotation to the bar by means of contact pressure springs, the operating mechanism comprising:

- a main opening and closing mechanism, associated with the main pole,
- an auxiliary mechanism associated with the auxiliary pole and comprising spring means,
- coupling means between the main mechanism and the auxiliary mechanism.

According to the invention, the spring means exerts on the one hand a torque on the bar of the auxiliary pole which opposes the force developed by the contact pressure springs of the auxiliary pole when the circuit breaker completes its closing travel and when it is closed, and on the other hand ceases to act on the bar of the auxiliary pole when the circuit breaker has begun its opening travel and when it is open.

In the stable open or closed position, the auxiliary pole is transparent with respect to the coupling means, i.e. the auxiliary pole does not induce any torsion and/or flexion torque on the rest of the mechanism. This torsion and/or flexion on the coupling means and on the main mechanism is present only during the opening and closing operations, which represents a tiny fraction of the lifetime of a switchgear apparatus, thus preventing operating mechanism fatigue problems.

According to a first embodiment, the spring means includes a traction spring arranged in a plane perpendicular to the transverse direction, a first end of which is coupled in rotation to the bar of the auxiliary pole and the second end of which is secured to a fixed point of the apparatus, the traction spring taking alternatively the following shapes:

- on the one hand, a straight line passing close to a fixed stop, located coaxially to the first transverse axis, when the circuit breaker completes its closing travel and when it is closed;
- on the other hand, a line broken at the level of the stop when the circuit breaker has begun its opening travel and when it is open.

According to a second embodiment, the spring means includes a rigid tie-rod and a traction spring fitted end to end by means of an articulation, the tie-rod/spring assembly being arranged in a plane perpendicular to the transverse axis. The free end of the tie-rod is coupled in rotation to the bar of the auxiliary pole, and the free end of the spring is secured to a fixed point of the apparatus, the tie-rod/spring assembly taking alternatively the following shapes:

- on the one hand, a straight line passing close to a fixed stop, located coaxially to the first transverse axis, when the circuit breaker completes its closing travel and when it is closed, the articulation being at the height of the stop;
- on the other hand, a line broken at the level of the articulation when the circuit breaker has begun its opening travel and when it is open.

According to a third embodiment, the free end of the tie-rod is articulated on a cap which is in turn articulated around a second transverse axis of the apparatus, and which cooperates with a crank secured in rotation to the bar, the stop being arranged coaxially with the second transverse axis.

Preferably, the cap is provided with a pin which cooperates with an aperture provided in the crank; the aperture comprises a radial part and a tangential part with respect to rotation of the crank.

The tie-rod is formed by a small plate articulated on the cap by means of two spigots, and the stop is formed by the spindle for articulation of the cap around the second transverse axis.

The four poles can notably be identical, the coupling means being formed by two connecting rods diametrically opposed with respect to the transverse axis and passing right through all the elementary bars.

BRIEF DESCRIPTION OF THE DRAWINGS

Other advantages and features will become more clearly apparent from the following description, represented in the accompanying drawings in which.

DESCRIPTION OF THE PREFERRED EMBODIMENT

Figure 1:
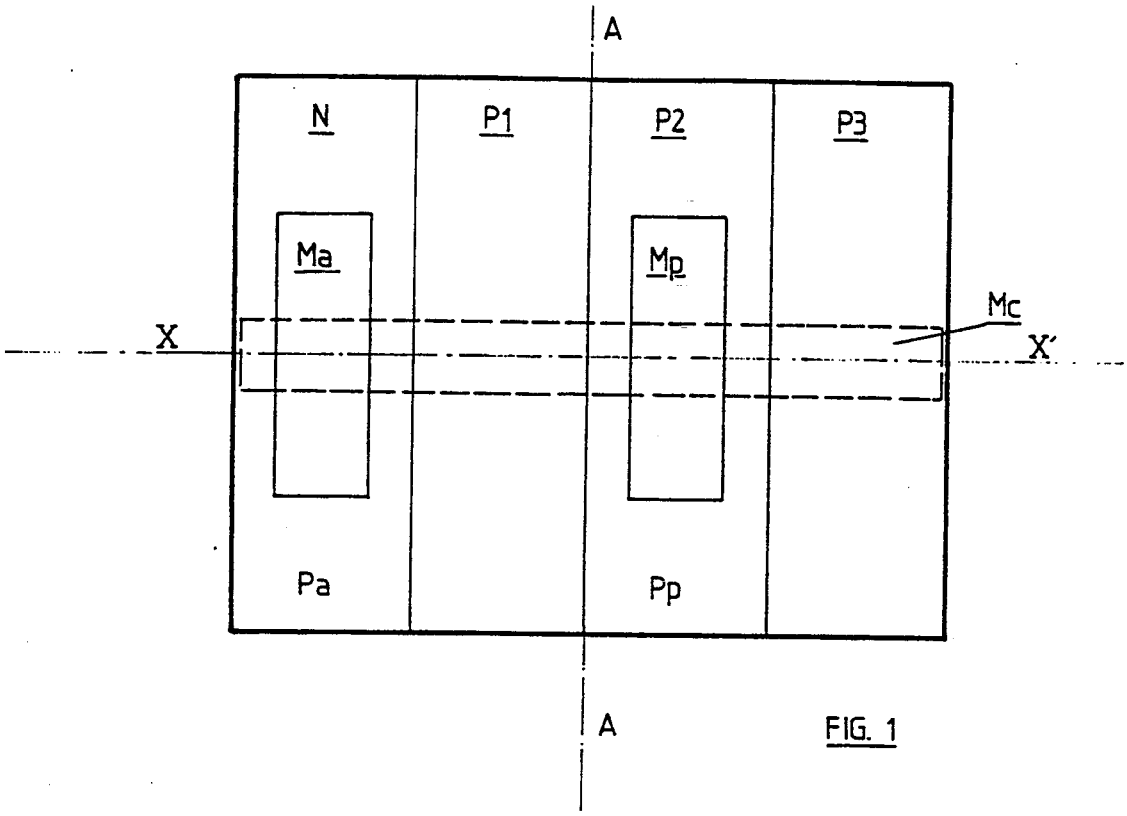
FIG. 1 is a schematic view of a four-pole switchgear apparatus.

In FIG. 1. a four-pole circuit breaker comprises three poles P1,P2 and P3 associated with the phase conductors of the power supply system, and a fourth pole N associated with the neutral conductor. The four circuit breaker poles are housed in parallelepipedic cases made of molded insulating material, placed side by side according to the transverse axis XX'; these cases can notably come in the form of four identical cases, each pole having its own case, or in the form of two cases, a first single-block case housing the poles P1,P2 and P3 and a second case for the pole N.

One of the two poles P2 or P3 adjacent to the symmetry plane AA will be designated as the "main pole Pp" (Pp being P2 in FIG. 1), the pole furthest away from the main pole Pp being designated as the "auxiliary pole Pa" (Pa being N in FIG. 1). The circuit breaker operating mechanism comprises a main mechanism Mp associated with the main pole Pp, and an auxiliary mechanism Ma associated with the auxiliary pole Pa, and designed to overcome the flexion and/or torsion phenomena arising from the dissymmetric position of the main mechanism Mp.

A coupling mechanism Mc connects the main mechanism Mp to the auxiliary mechanism Ma.

The main mechanism Mp is actuated in state-of-the-art manner, either by manual action by means of an operating handle (not represented) or by means of a thermomagnetic or electronic trip device (not represented).

Figure 2:
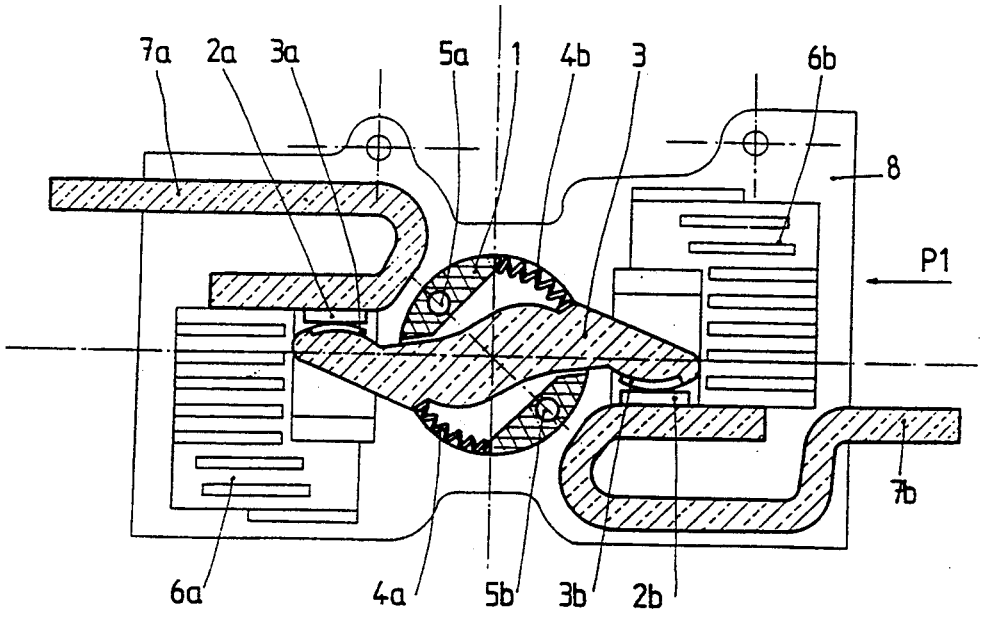
FIG. 2 is a cross-section across a pole.

FIG. 2 represents a breaking pole P1 particularly well-suited to the invention on account of its modularity. In other words, the four poles P1,P2,P3 and N are strictly identical and are designed so as to be capable to receive a main mechanism Mp or an auxiliary mechanism Ma, which enables manufacture of the circuit breakers to be greatly rationalized: it is notably possible with a single pole production line to assemble these poles to achieve a two-pole, three-pole or four-pole circuit breaker.

The breaking pole P1 is housed in a case 8 made of molded insulating material, in which two breaking chambers 6*a* and 6*b* are arranged. The pole P1 comprises a double-breaking rotary contact 3 which cooperates with two stationary contacts 2*a* and 2*b* respectively connected to the connection terminals 7*a* and 7*b*. The rotary contact 3 is housed in a rotary elementary switching bar 1 made of insulating material which is guided in rotation around the axis ZZ'. The rotary contact 3 is coupled to the bar 1 by means of two contact pressure springs 4*a* and 4*b*.

The document EP-A-314,540 should be advantageously referred to for further explanations on the breaking pole, or for other embodiments of the breaking pole.

The bar 1 has drilled in it two holes diametrically opposite with respect to the transverse axis ZZ' and designed to receive two transverse connecting rods 5*a* and 5*b* providing full mechanical coupling Mc of all four poles P1,P2,P3 and N, and thereby coupling of the main mechanism Mp with the auxiliary mechanism Ma.

Figure 3A:
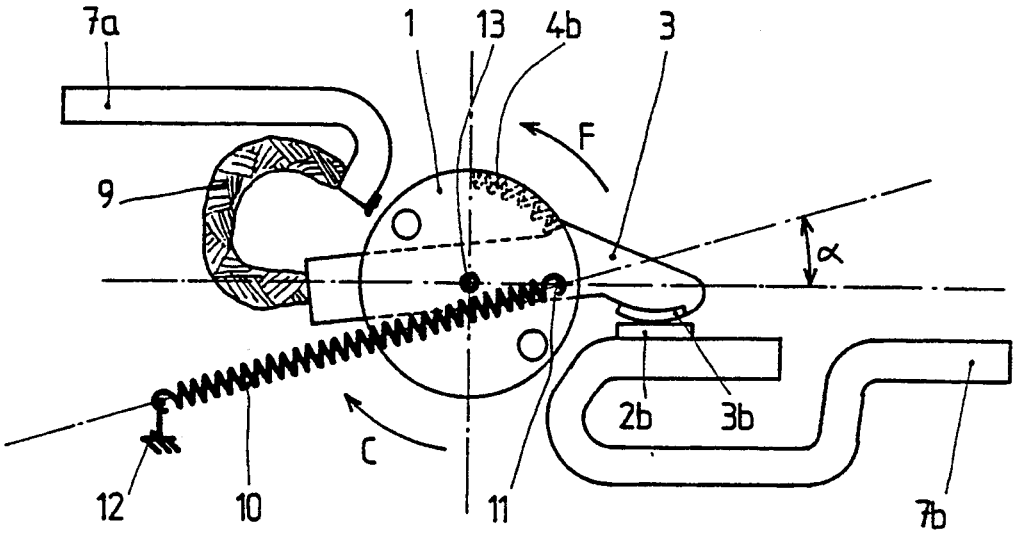
FIGS. 3A and 3B illustrate a first embodiment of the invention.
Figure 3B:
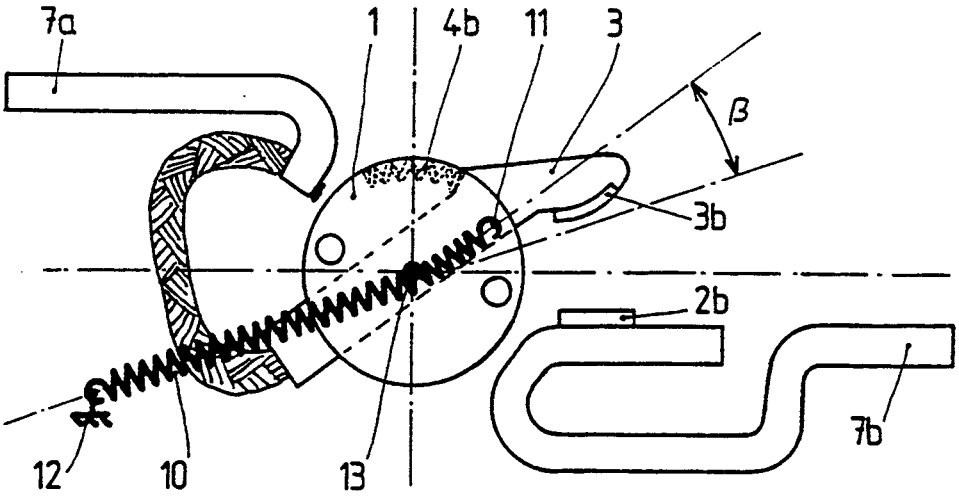

With reference to FIGS. 3A and 3B, we will now deal with a first embodiment of the auxiliary mechanism Ma associated with the auxiliary pole Pa. FIGS. 3A and 3B show a single-break rotary contact 3, respectively in the closed and open positions of the pole, the second break having been replaced by a braided strip 9 which connects the rotary contact 3 to the connection terminal 7*b*. The rotary contact 3, housed in the rotary bar 1, is coupled to the bar 1 by a contact pressure spring 4*b*, which when the pole is closed, exerts a reaction force F on the bar 1 as indicated in FIG. 3A.

A traction spring 10 is attached at one of its ends to a hook 11 secured to the bar 1 and located on a radius of the bar 1. The other end of the spring 10 is attached to a fixing point 12 secured to the case 8, in such a way that the spring 10, in the closed position of the pole, is straight and practically touches a stop 13 secured to the bar 1 and located on the rotation axis ZZ' of the bar 1.

In other words, the traction spring 10 stretched straight forms a slight angle $\alpha$ with the diameter of the bar passing through the hook 11, so as to exert a torque C on the bar in the opposite direction to the force F, i.e. so as to keep the contacts closed.

Suitable selection of the characteristics of the springs 4*b* and 10 enables the operating mechanism to be transparent when the switchgear apparatus is closed.

When the transverse connecting rods 5*a* and 5*b* are subjected to a rotation movement around the axis XX', due to the effect of the main mechanism Mp, the bar 1 rotates to the open position, illustrated in FIG. 3B. As soon as the bar 1 has started its rotation movement, the intermediate part of the spring 10 comes up against the stop 13 forming a broken line of angle $\beta$, which has the effect of suppressing the torque C on the bar 1; in other words, as soon as the contacts separate, the traction spring 10 ceases to oppose opening of the contacts.

In the open position, the auxiliary mechanism is again transparent on the rest of the operating mechanism.

Figure 4A:
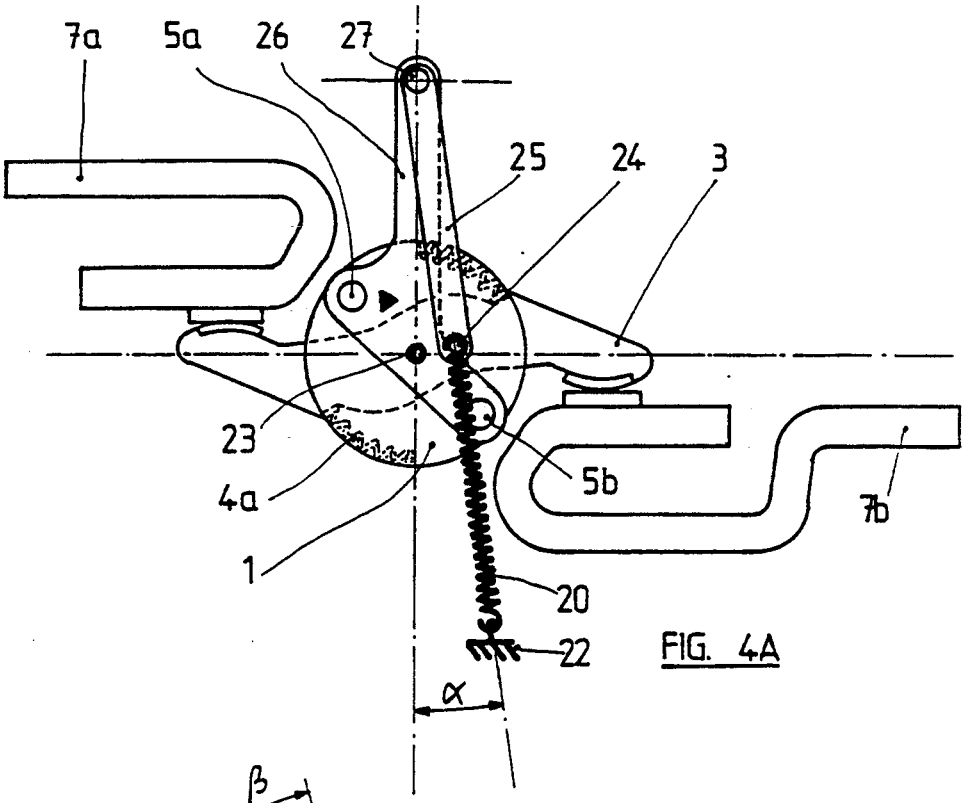
FIGS. 4A and 4B illustrate a second embodiment of the invention.
Figure 4B:
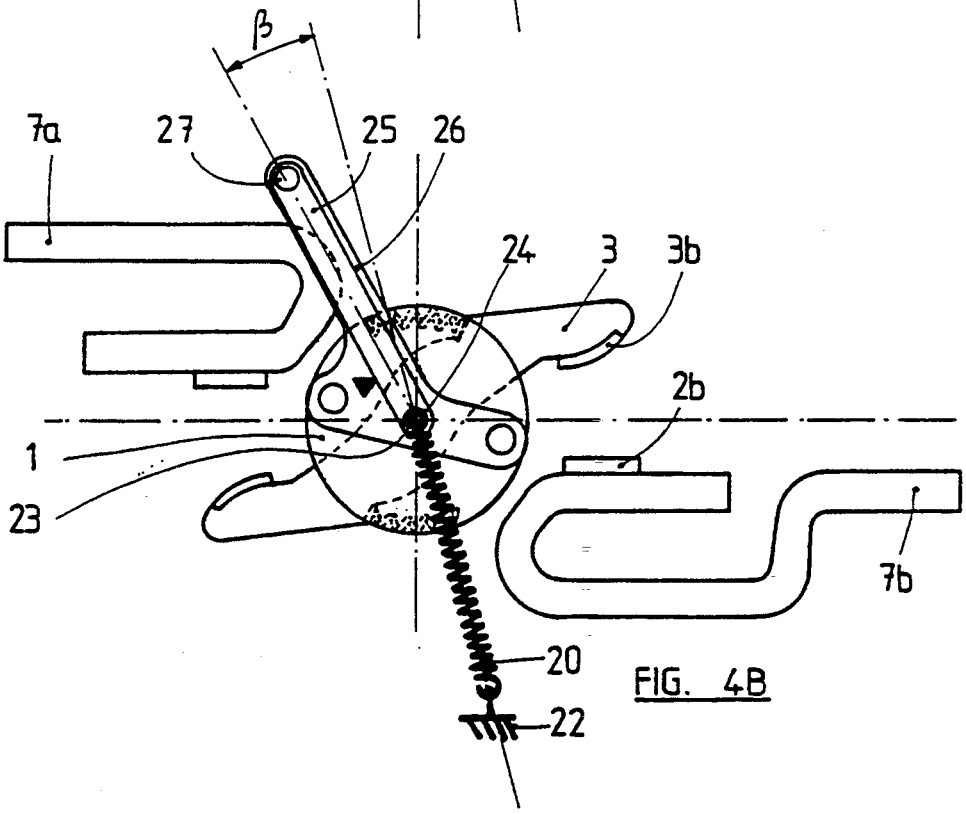

FIGS. 4A and 4B illustrate a second embodiment of the auxiliary mechanism associated with a double-break rotary contact. The spring means of the mechanism includes a tie-rod 25 and traction spring 20 placed end to end by means of a pivot 24. The free end of the tie-rod is coupled by an articulation 27 to the end of a crank 26 secured to the elementary bar 1. The free end of the spring 20 is attached to a fixing point 22 secured to the case. In the closed position of the contacts, the tie-rod 25/spring 20 assembly is straight and forms a slight angle $\alpha$ with the diameter of the bar 1 passing through the articulation 27. The pivot 24 is close to a stop 23 secured to the crank 26, and arranged coaxially with the transverse axis XX'. The tie-rod 25/spring 20 assembly exerts a torque on the bar 1 which opposes the force developed by the contact pressure springs 4*a*,4*b* on the bar 1.

As soon as the bar 1 is animated with a rotation movement via the connecting rods 5*a*,5*b* with a view to opening of the contacts, the pivot 24 comes up against the stop 23, which has the effect of suppressing the torque developed by the tie-rod 25/spring 20 assembly, as soon as the contacts separate and when the contacts are open, the tie-rod 25/spring 20 assembly then forms an angle $\beta$ at the level of the pivot 24. Inversely, in the course of the contact closing cycle, the tie-rod 25/spring 20 assembly reverts to the straight disposition and again exerts a torque on the bar 1 as soon as the pivot 24 moves away from the stop 23, i.e. as soon as the contacts come effectively into contact.

The advantage of this second embodiment over the first embodiment lies in the fact that as a larger useful angular range is available, on account of the crank 26, adjustment of the angle $\alpha$ is less critical for correct operation of the breaking pole.

The third embodiment described with reference to FIGS. 5A, 5B,5C and 6 is the preferred embodiment of the invention.

According to this mode as described hereinafter, the spring means of the auxiliary mechanism are no longer directly secured to the bar 1.

The case 8 of the pole N is equipped with a plate 31 fixed laterally by means of screws 40 and 41, which covers the top of the pole P. The plate 31 supports a rotation spindle 33 according to the axis YY' on which a cap 34 is fitted. The cap 34 is guided in rotation around the axis YY' by means of a crank 36 secured to the bar 1; this guiding is performed by a lateral pin 37 secured to the cap 34, which fits into an aperture 38 provided in the crank 36.

The spring means of the auxiliary mechanism comprise a tie-rod 35 formed by a small plate and a spring 30 attached end to end near the rotation spindle 33.

The free end of the tie-rod 35 is articulated on the vertical flanks of the cap 34 by means of two spigots 39, and the free end of the spring 30 is attached to a fixing point 32 of the plate 31.

Figure 5A:
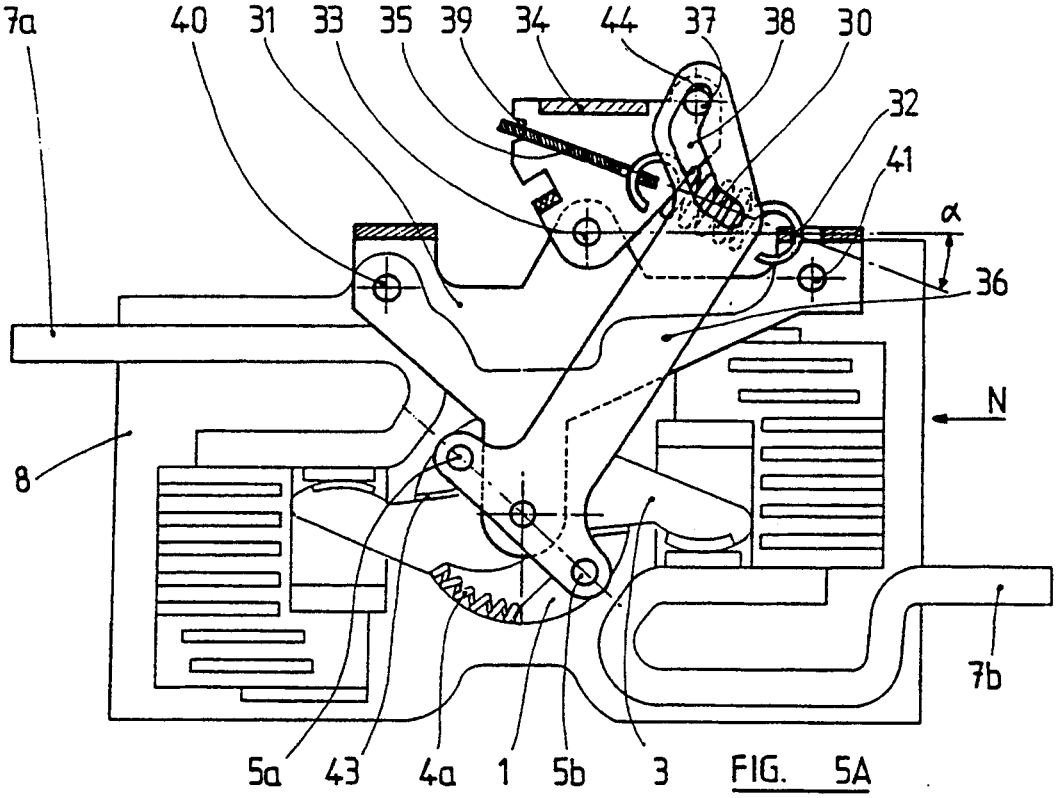
FIGS. 5A,5B and 5C illustrate a third embodiment of the invention.
Figure 6:
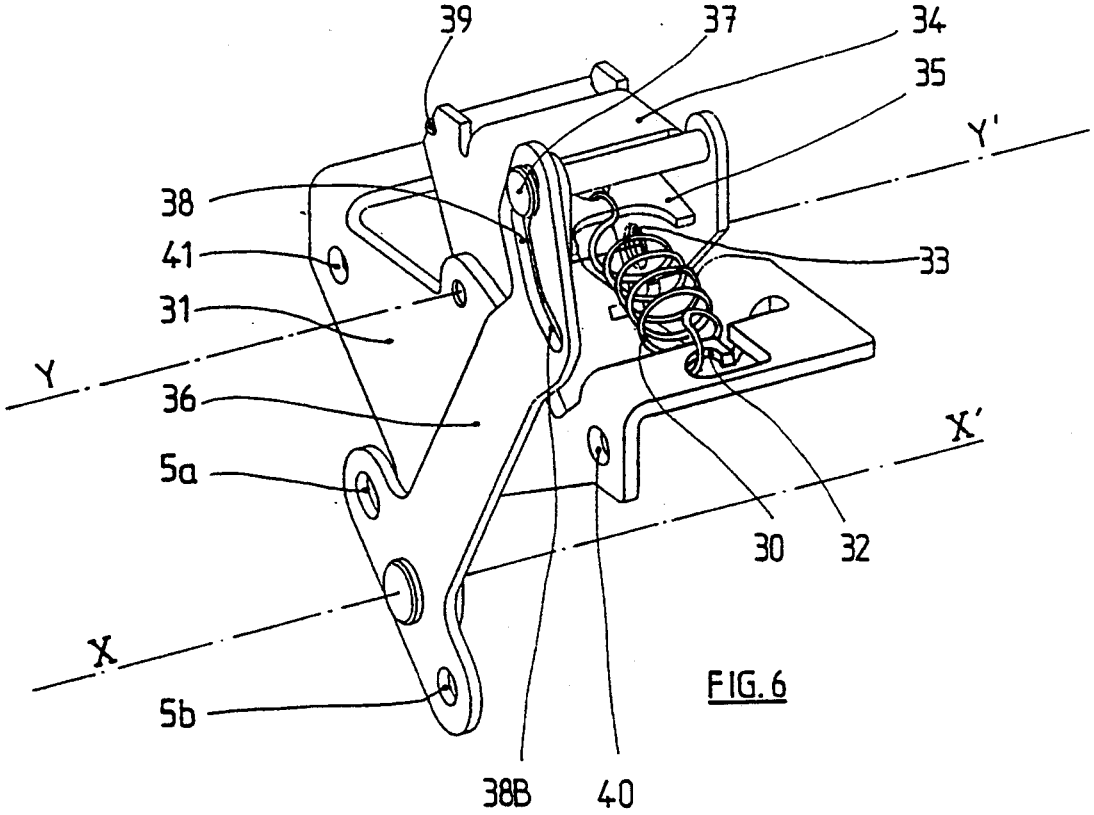
FIG. 6 represents, with reference to the third embodiment, a perspective of the auxiliary mechanism associated with the fourth pole.

In the closed position of the pole, illustrated in FIG. 5A, the spring 30/tie-rod 35 assembly is straight and forms an angle $\alpha$ with the line passing through the rotation spindle 33 and the fixing point 32. The spring 30 then exerts a torque which opposes the force developed by the contact pressure springs 4*a* and whose value is such that it leaves a gap 43 between the bar 1 and rotary contact 3, which acts as wear clearance for the contacts 2*a*,2*b*,3*a*,3*b*. A gap 44 also exists between the pin 37 and a first end of the aperture 38.

Figure 5B:
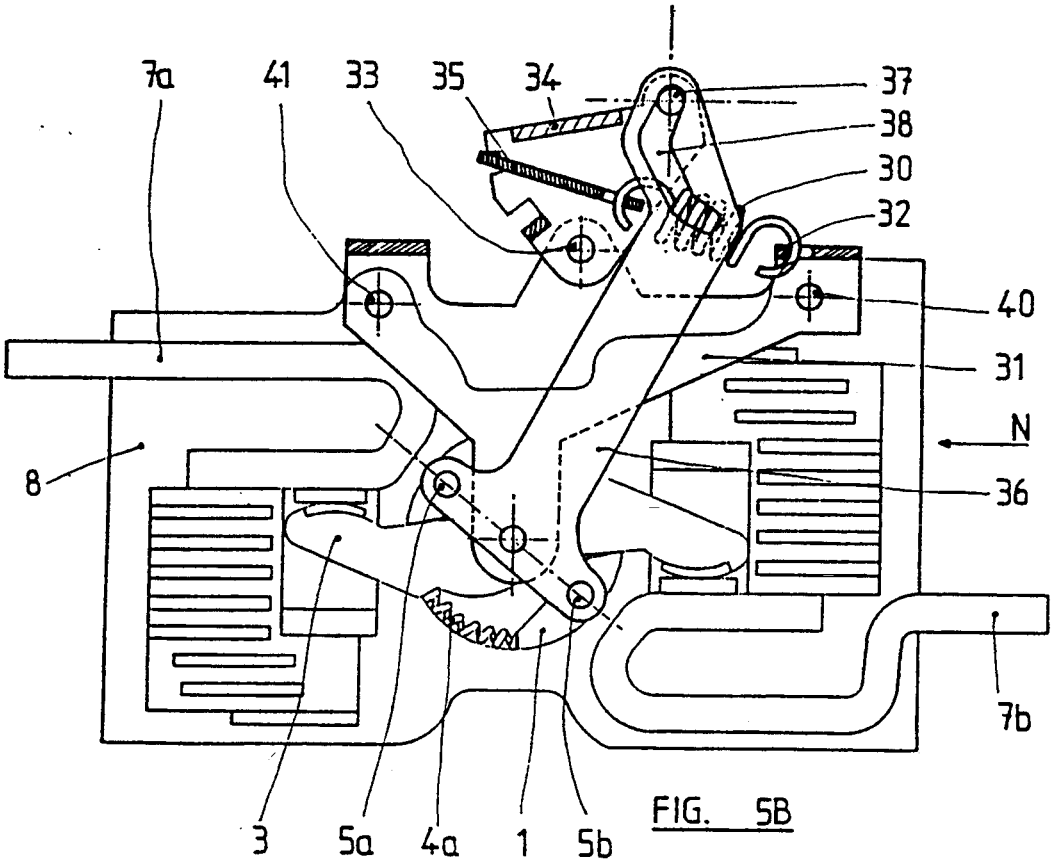

As soon as the bar 1 is driven in rotation by means of the connecting rods 5*a* and 5*b*, as illustrated in FIG. 5B, the cap 34 begins its rotation movement around the spindle 33, thus driving the small plate 35.

As soon as the contacts separate, the tie-rod 35 moves onto the spindle 33, which has the effect of suppressing the torque exerted on the cap 35, and consequently on the crank 36 and on the bar 1.

Figure 5C:
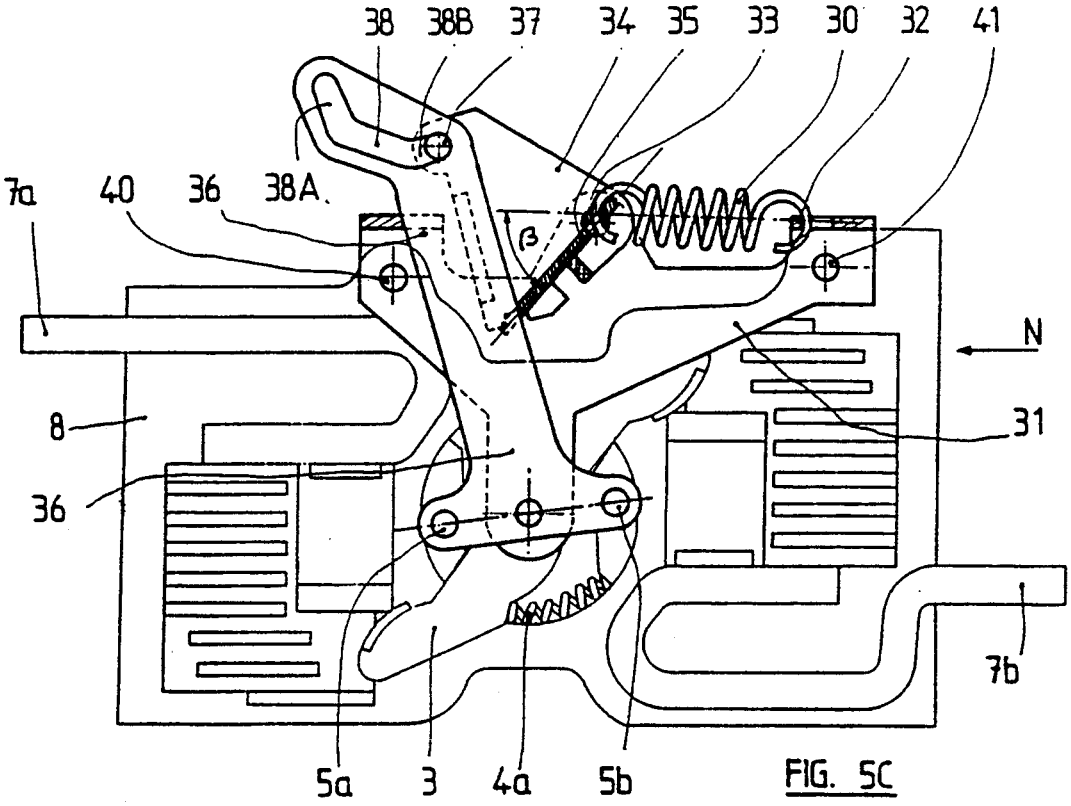

In the open position of the pole N as illustrated in FIG. 5C, the small plate 35 and spring 30 assembly forms an angle $\beta$ and the pin 37 has moved to the second end of the aperture 38.

The aperture 38 provided in the crank 36 has a radial part 38A and a tangential part 38B with respect to rotation of the crank. The radial part 38A of the aperture 38 enables the useful angular range to be geared down considerably when the transition takes place between a straight tie-rod 35/spring 30 assembly in the closed position, and a broken tie-rod 35/spring 30 assembly in the open position; it also enables the length of the spring 30 to be reduced. The tangential part 38B of the aperture 38 enables the bar 1 to continue its opening travel without having to drive the cap 34.

The arrangement of the auxiliary mechanism of this third embodiment is particularly advantageous, as it presents very small dimensions and does not require any particular adjustment of the angle $\alpha$ on account of the gearing down of the useful angular range. Furthermore, the fact that the auxiliary mechanism can be fitted to a standard pole, i.e. a pole identical to those associated with the phases, enables manufacture of the poles to be greatly rationalized.

In the embodiments described above, the coupling means Mc are achieved by elementary bars secured by means of two connecting rods 5*a*,5*b*; these coupling means can be modified, for example by using a single bar for the four poles, or a single bar for the three poles associated with the phases coupled to a bar for the pole associated with the neutral, without departing from the scope of the invention.

I claim:

1. An operating mechanism for a four-pole circuit breaker for simultaneously operating the four poles, the four poles being arranged side-by-side along a transverse direction such that a main pole is adjacent to a symmetry plane and an auxiliary pole is furthest away from the main pole, the auxiliary pole including a rotary elementary switching bar rotatable around a first transverse axis, at least one stationary contact, and a rotary contact cooperable with said at least one stationary contact, the rotary contact being rotatably coupled to the rotary elementary switching bar via at least one contact pressure spring, said operating mechanism comprising:

a main opening and closing mechanism connected to said main pole;

an auxiliary opening and closing mechanism connected to said auxiliary pole, said auxiliary opening and closing mechanism comprising spring means for exerting a torque on the rotary elementary switching bar in a closed position of the circuit breaker, said torque opposing a force exerted by the contact pressure spring on the rotary elementary switching bar, said spring means being arranged so as to exert substantially no torque on the rotary elementary switching bar when the circuit breaker is in an open position; and coupling means for coupling said main opening and closing mechanism and said auxiliary opening and closing mechanism to each other.

2. The operating mechanism of claim 1, wherein said spring means comprises a traction spring extending in plane perpendicular to said transverse direction, a first end of the traction spring being coupled to the rotary elementary switching bar, a second end of the traction spring being secured to a fixed point, wherein, in the closed position, the traction spring extends along a straight line, and, in the open position, the traction spring extends along a broken line wherein the traction spring abuts a stop which is coaxially arranged along said first transverse axis.

3. The operating mechanism of claim 2, wherein said first end of the traction spring is articulated to an attachment secured to the rotary elementary switching bar along a radius thereof, said stop being secured to the rotary elementary switching bar.

4. The operating mechanism of claim 1, wherein the spring means comprises a rigid tie-rod and a traction spring, a first end of each of the tie-rod and traction spring being coupled together so as to form a joint, the tie-rod and traction spring forming a tie-rod spring assembly which extends along a plane perpendicular to the transverse direction, a second end of the tie-rod being coupled to a cap which is rotatable around a second transverse axis, a second end of the traction spring being coupled to a fixed point, wherein, in the closed position, the tie-rod spring assembly forms a straight line, said joint being adjacent to a stop which is coaxial with said second transverse axis, and, in the open position, the tie-rod spring assembly forms a broken line via said joint contacting said stop.

5. The operating mechanism of claim 4, further comprising a crank which is secured to said rotary elementary switching bar so as to be rotatable therewith.

6. The operating mechanism of claim 5, wherein said cap has a pin which extends into an aperture in said crank, said pin being slidable in said aperture.

7. The operating mechanism of claim 6, wherein said aperture comprises a first portion which is radial and a second portion which is tangential with respect to the rotation of the crank.

8. The operating mechanism of claim 4, wherein said tie-rod comprises a small plate which is jointed to the cap via two pins, said stop being formed by a spindle extending along said second transverse axis.

9. The operating mechanism of claim 1, wherein said rotary elementary switching bar of the auxiliary opening and closing mechanism is connected to bars of the other three poles.

10. The operating mechanism of claim 1, wherein the four poles are identical to each other, said coupling means comprising two connecting rods diametrically opposed with respect to the first transverse axis, said two connecting rods passing through a rotary elementary switching bar in each of the poles.

11. The operating mechanism of claim 1, wherein said spring means comprises a rigid tie-rod and a traction spring, a first end of each of the tie-rod and traction spring being coupled together so as to form a joint, the tie-rod and traction spring forming a tie-rod spring assembly which extends along a plane perpendicular to the transverse direction, a second end the tie-rod being coupled to the rotary elementary switching bar, a second end of the traction spring being secured to a fixed point, wherein, in the closed position, the tie-rod spring assembly forms a straight line, said joint being adjacent to a stop which is coaxial with said first transverse axis, and, in the open position, the tie-rod spring assembly forms a broken line via said joint contacting said stop.

12. The operating mechanism of claim 11, wherein said second end of the tie-rod is connected to a pivot which is secured to the rotary elementary switching bar along a radius thereof, said stop being secured to said rotary elementary switching bar.

* * * * *